US005291176A

United States Patent [19]

Fujita

[11] Patent Number: 5,291,176

[45] Date of Patent: Mar. 1, 1994

[54] SLIDE TYPE VARIABLE RESISTOR

[75] Inventor: Masahiro Fujita, Kanagawa, Japan

[73] Assignee: Sony Corporation, Japan

[21] Appl. No.: 899,614

[22] Filed: Jun. 16, 1992

[30] Foreign Application Priority Data

Jun. 24, 1991 [JP] Japan ..... 3-151908

[51] Int. Cl.[5] ..... H01C 10/16; H01C 10/38

[52] U.S. Cl. ..... 338/125; 338/126; 338/176

[58] Field of Search ..... 338/126, 176, 92, 125, 338/140, 171

[56] References Cited

U.S. PATENT DOCUMENTS

| | | | |
|---|---|---|---|
| 1,858,364 | 5/1932 | Koenig, Jr. | 338/125 |
| 2,747,061 | 5/1956 | Sorber | 338/125 |
| 3,456,228 | 7/1969 | Wright | 338/126 |
| 3,886,514 | 5/1975 | Oka | 338/126 |
| 3,944,962 | 3/1976 | Honda | 338/126 |
| 4,010,439 | 3/1977 | Lace | 338/125 |
| 4,274,074 | 6/1981 | Sakamoto | 338/171 X |
| 4,435,691 | 3/1984 | Ginn | 338/125 |
| 4,500,866 | 2/1985 | Romann et al. | 338/126 |

*Primary Examiner*—Marvin M. Lateef
*Attorney, Agent, or Firm*—Ronald P. Kananen

[57] ABSTRACT

A variable resistor includes a first resistor having linear resistance or attenuation characteristic, a second resistor disposed along the first resistor and having the linear resistance or attenuation characteristic, and a slider for bridging the first and second resistors, wherein one end of each of the first and second resistors is connected with each other.

12 Claims, 7 Drawing Sheets

SLIDE TYPE VARIABLE RESISTOR

BACKGROUND OF THE INVENTION

1. Field of the Invention

The present invention relates to variable resistors and, more particularly, is directed to a slide type variable resistor suitable for use as a volume controller.

2. Description of the Prior Art

A variable resistor is generally represented in the drawings by a resistor 1 and a slider 2, as shown in FIG. 1A. However, in a practical variable resistor, a conductive thin lead 3 for current collection is disposed along the main resistor 1, and the lead 3 and the resistor 1 are bridged by the slider 2 as shown in FIG. 1B.

The variable resistor for use as a volume controller is required, as is well known, to have a logarithmic resistance characteristic in resistance change thereof, and so the variable resistor having a so-called A-curve resistance characteristic is utilized for controlling the volume.

In order to realize the variable resistor having the non-linear resistance characteristic, the following two manufacturing methods have been proposed.

In the first method, resistors having different resistance values are printed many times.

In the second method, a trimming process of the resistor pattern is performed after the printing of the resistor.

However, the second method has the disadvantage such that many numbers of processings are required after the printing process of the resistor, thereby remarkably increasing the cost of the variable resistor.

In the first method, since the accuracy of the resistance characteristic depends on the accuracy of the printing of resistors, the resistance characteristic fluctuates for every variable resistor.

When two variable resistors having different resistance characteristics due to the fluctuation, for example, are interconnected with each other so as to be cooperated and used to control the volume of stereophonic sound, the position of a reproduced sound image disadvantageously fluctuates to the righthand or lefthand side.

A sound control console in a broadcasting station or the like employs a slide type variable resistor since the adjusting position can be visually recognized. In this case, if the resistance characteristic fluctuates at every variable resistor, a difference between an actual attenuation degree of the variable resistor and a scale of attenuation degree thereof on the sound control console will disadvantageously fluctuate for every variable resistor.

In particular, when the variable resistors having different resistor characteristics are employed in a multichannel mixer, many adjusting levers interlinked with the sliders of the resistors, which are to be arranged in a linear line, are arranged in a zigzag fashion. Thus, in this case, the adjustment of volume may be seen to be erroneous for an operator.

OBJECTS AND SUMMARY OF THE INVENTION

Therefore, it is an object of the present invention to provide an improved slide type variable resistor in which the aforementioned shortcomings and disadvantages encountered with the prior art can be eliminated.

More specifically, it is an object of the present invention to provide a slide type variable resistor which has a resistance characteristic of a high accuracy and is suitable for controlling sound volume and which can be made inexpensive with ease.

As an aspect of the present invention, a slide type variable resistor is comprised of a first resistor having a linear resistance or attenuation characteristic, a second resistor disposed along the first resistor and having the linear resistance or attenuation characteristic, a slider for connecting the first and second resistors, and a unit for connecting one end of each of the first and second resistors.

According to the thus-constituted slide type variable resistor, a variable resistor having the resistance characteristic of a high accuracy suitable for controlling sound volume can be realized easily at a low cost.

The preceding and other objects, features, and advantages of the present invention will become apparent from the following detailed description of illustrative embodiments thereof when read in conjunction with the accompanying drawings.

DETAILED DESCRIPTION OF THE PREFERRED EMBODIMENTS

A slide type variable resistor according to the first embodiment will now be described with reference to FIGS. 2 through 4.

Figure 1A:
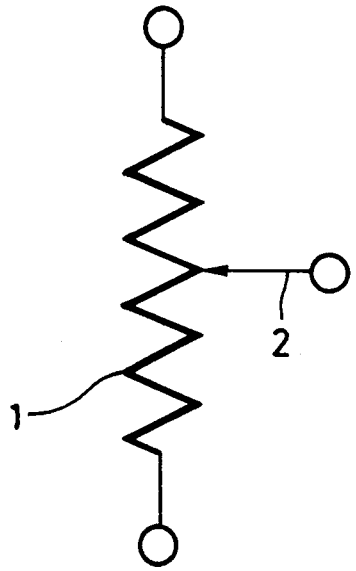
FIG. 1A (PRIOR ART)
FIGS. 1A and 1B are respectively schematic diagrams showing arrangements of the conventional slide type variable resistors.
Figure 1B:
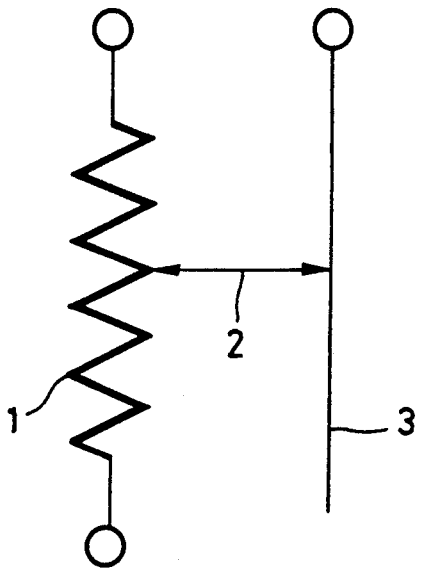
FIG. 1B (PRIOR ART)
Figure 2:
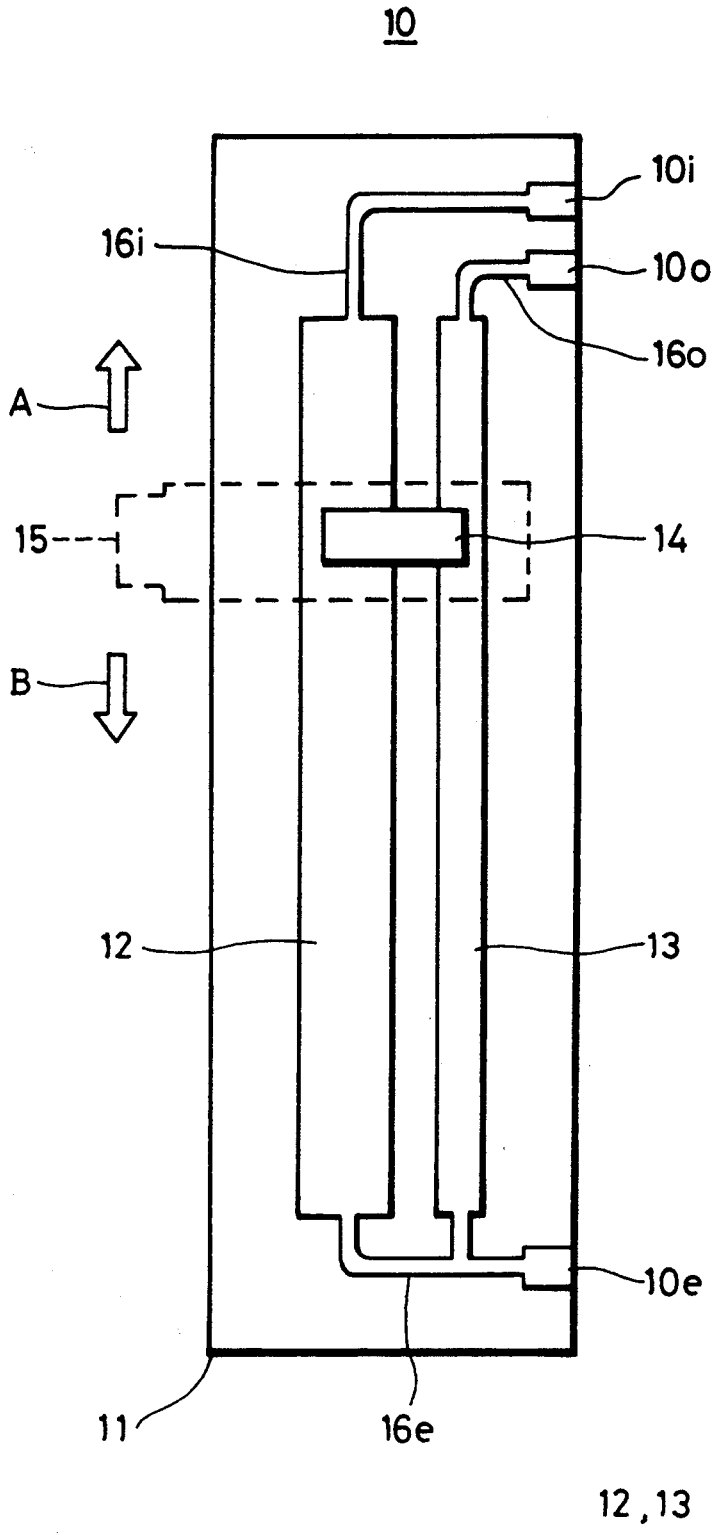
FIG. 2 is a plan view illustrating an arrangement of a slide type variable resistor according to a first embodiment of the present invention.

FIG. 2 of the accompanying drawings shows an arrangement of the first embodiment of the present invention. Referring to FIG. 2, a variable resistor 10, constituted to be a slide type one in this embodiment, is formed by printing a main resistor 12 made of a carbonaceous film in a band-like configuration on an insulating substrate 11 such as a laminated plate made of phenol resin or the like. A resistor 13 made of a carbonaceous film is formed by a printing process on the substrate 11 along the resistor 12 at a position where the lead 3 for current collection has been disposed in the conventional variable resistor (see FIG. 1B).

In this embodiment, each of the resistors 12 and 13 is selected to have a linear resistance characteristic, that is, so-called B-curve resistance characteristic. Thus, the manufacturing process of the variable resistor 10 can be decreased and the resistance characteristic of a high accuracy can be realized easily.

Resistance values R12 and R13 of the resistors 12 and 13 may be selected to be 25 kΩ and 5 kΩ, for example, respectively.

A slider 14 for interconnecting the resistors 12 and 13 is unitarily formed with a lever 15 so as to be movable to a direction shown by open arrows A and B.

An input terminal 10*i*, an output terminal 10*o*, and a ground terminal 10*e* are provided at an end portion of the substrate 11. The ground terminal 10*e* is connected to one end of each of the resistors 12 and 13 by a lead 16*e*. The input terminal 10*i* and the output terminal 10*o* are connected to the other ends of the resistors 12 and 13 through leads 16*i* and 16*o*, respectively.

Operation of the first embodiment will be described below with reference to FIGS. 3 and 4.

Figure 3:
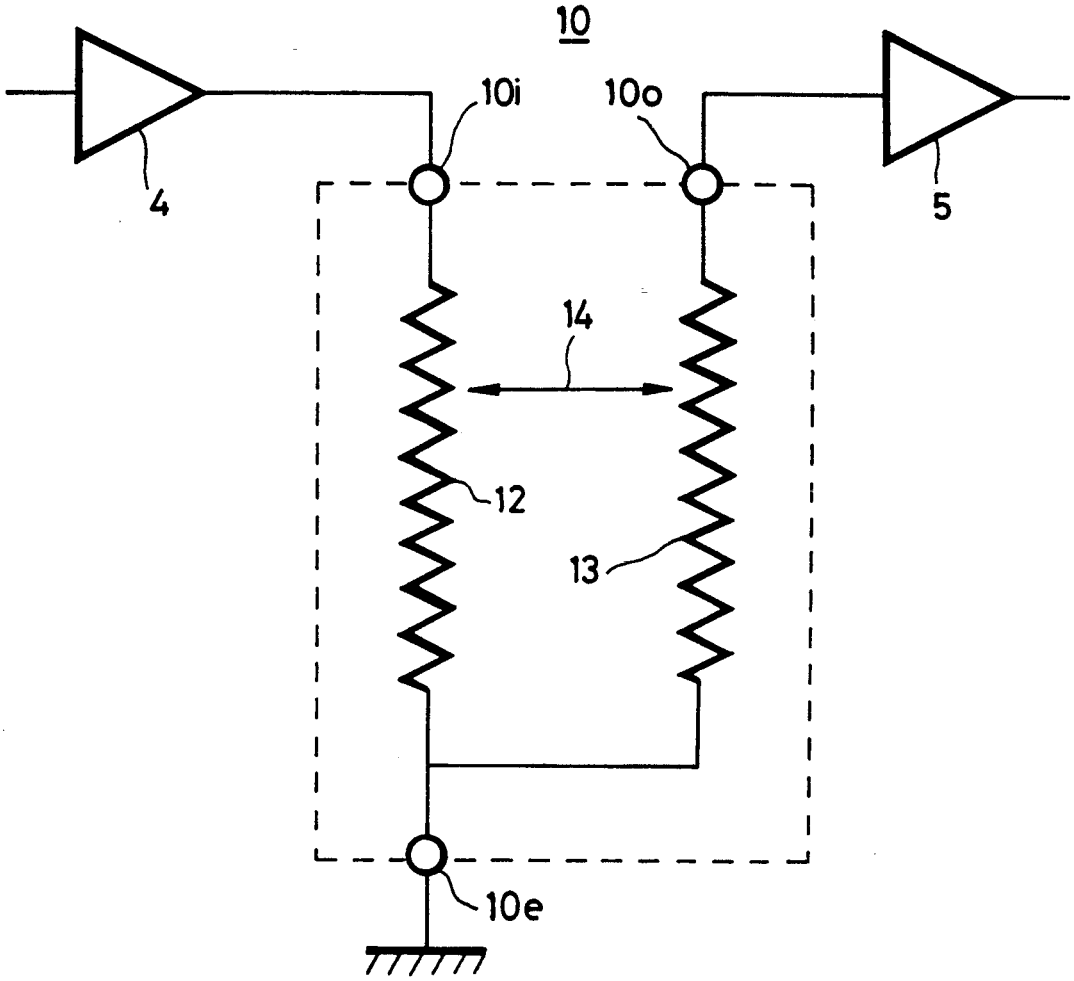
FIG. 3 is a diagram of the slide type variable resistor according to the first embodiment, and to which references will be made in explaining the operation thereof.

Referring to FIG. 3, which illustrates an example of a circuit diagram to which the first embodiment is applied, an audio signal is applied to the input terminal 10*i* of the variable resistor 10 from a preamplifier 4. The audio signal is attenuated by the variable resistor 10 by a degree determined by the position of the slider 14, and then applied through the output terminal 10*o* to a main amplifier 5.

An output impedance of the preamplifier 4 is substantially zero and an input impedance of the main amplifier 5 is infinite. Thus, a portion of the resistor 13 positioned between the output terminal 10*o* and the slider 14 does not affect the attenuation degree of the variable resistor.

As described above, the resistance characteristic of each of the resistors 12 and 13 is the so-called B-curve characteristic. Thus, when only the resistor 12 is connected to the ground terminal 10*e* as in the case of the conventional variable resistor shown in FIG. 1A, the resistance or amount of the variable resistor will be one shown by a broken line Lb in FIG. 4. In this case, the attenuation degree of the variable resistor will be only 6 dB when the slider 14 is positioned at a center portion of the resistor 12, that is, when a shift amount of the slider 14 is 50% of the entire length of the resistor 12. Further, when the shift amount exceeds 90%, the changing ratio of the attenuation degree increases abruptly, which is not suitable for controlling the sound volume.

Figure 4:
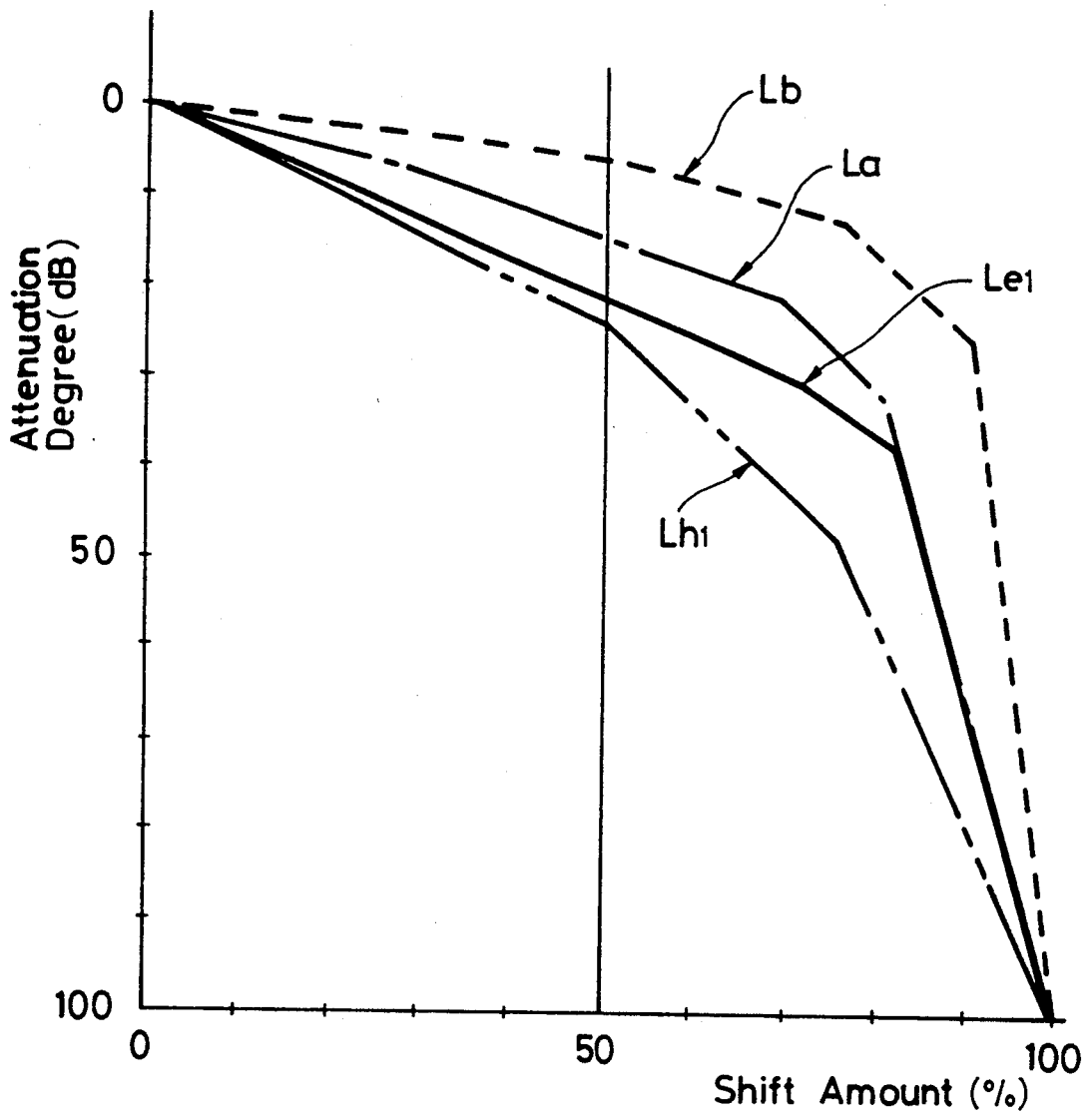
FIG. 4 is a schematic diagram showing resistance characteristics of the slide type variable resistor according to the first embodiment.

The resistance or attenuation characteristic of the normal variable resistor with the A-curve characteristic will be one shown by a one dot chain line La in FIG. 4. In this case, the attenuation degree of the variable resistor at 50% of the amount of shift will be slightly larger when compared with the resistance or attenuation characteristic Lb of the variable resistor with the B-curve characteristic.

However, the resistance or attenuation characteristic La of the variable resistor with the A-curve characteristic is slightly insufficient in the attenuation degree at 50% of the shift amount when compared with resistance or attenuation characteristic of a high grade volume controller shown by a two-dot chain line Lhi. Thus, the variable resistor with the A-curve characteristic is also not suitable for a volume controller.

In order to obviate these problems, the variable resistor according to the first embodiment is constituted in a manner that a ratio between the resistance values of the resistors 12 and 13 with the B-curve characteristic is set to be 5:1, for example, so as to form the variable resistor with resistance or attenuation characteristic shown by a steady line Le1. In this case, the attenuation degree of the variable resistor at 50% of the amount of shift is slightly increased to a level almost equal to that of the high grade volume controller with the attenuation characteristic Lhi. Further, the resolution of the attenuation degree is kept at a high level below about 80% of the amount of shift of the slider 14. Thus, the variable resistor in this embodiment can provide the resistance characteristic suitable for the volume control.

A slide type variable resistor according to the second embodiment will now be described with reference to FIGS. 5 through 7.

Figure 5:
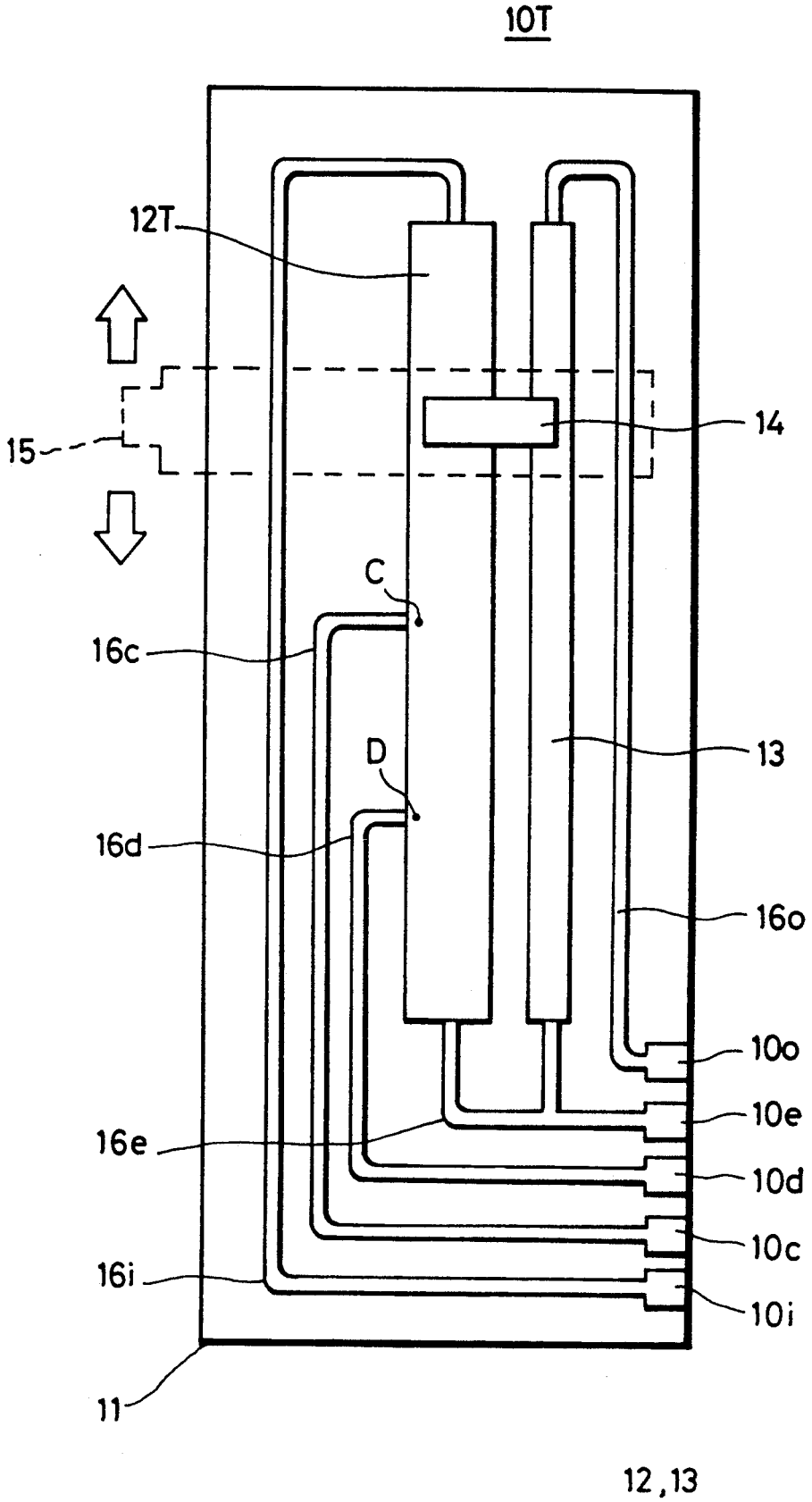
FIG. 5 is a plan view showing an arrangement of a slide type variable resistor according to a second embodiment of the present invention.

FIG. 5 shows an arrangement of the second embodiment of the present invention. In FIG. 5, like parts corresponding to those of FIG. 2 are marked with the same reference numerals and therefore need not be described in detail.

Referring to FIG. 5, a variable resistor 10T is mainly constituted by a main resistor 12T and a second resistor 13. The main resistor 12T has intermediate taps C and D provided at positions corresponding to 50% and 70% of the shift amount of the slider 14, respectively.

Intermediate terminals 10*c* and 10*d* are provided at an end edge of the substrate 11 in association with the intermediate terminals C and D, respectively. The intermediate terminals 10*c* and 10*d* are connected to the intermediate terminals C and D through leads 16*c* and 16*d*, respectively. A rest of the elements in FIG. 5 is the same as that in FIG. 2.

Operation of the second embodiment will be described below with reference to FIGS. 6 and 7.

Figure 6:
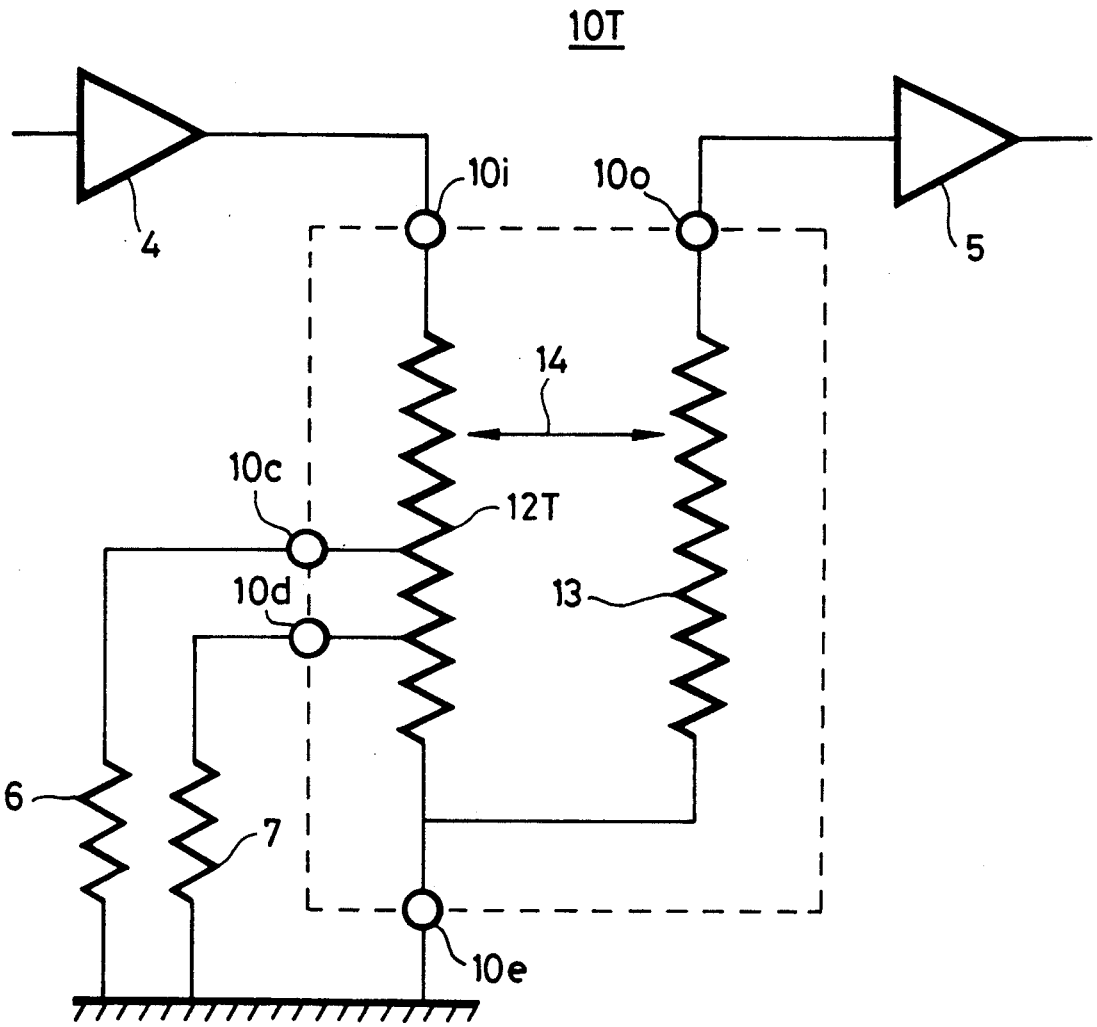
FIG. 6 is a diagram of the slide type variable resistor according to the second embodiment, and to which references will be made in explaining operation thereof.

Referring to FIG. 6 which illustrates an example of a circuit diagram to which the second embodiment is applied, the ground terminal 10*e* of the variable resistor 10T is connected to the intermediate terminals 10*c* and 10*d* through resistors 6 and 7, respectively. Resistance values R7 and R8 of the resistors 6 and 7 are set to be 1.8 kΩ and 330Ω, for example, respectively. A rest of the elements in FIG. 6 is the same as that in FIG. 3.

Figure 7:
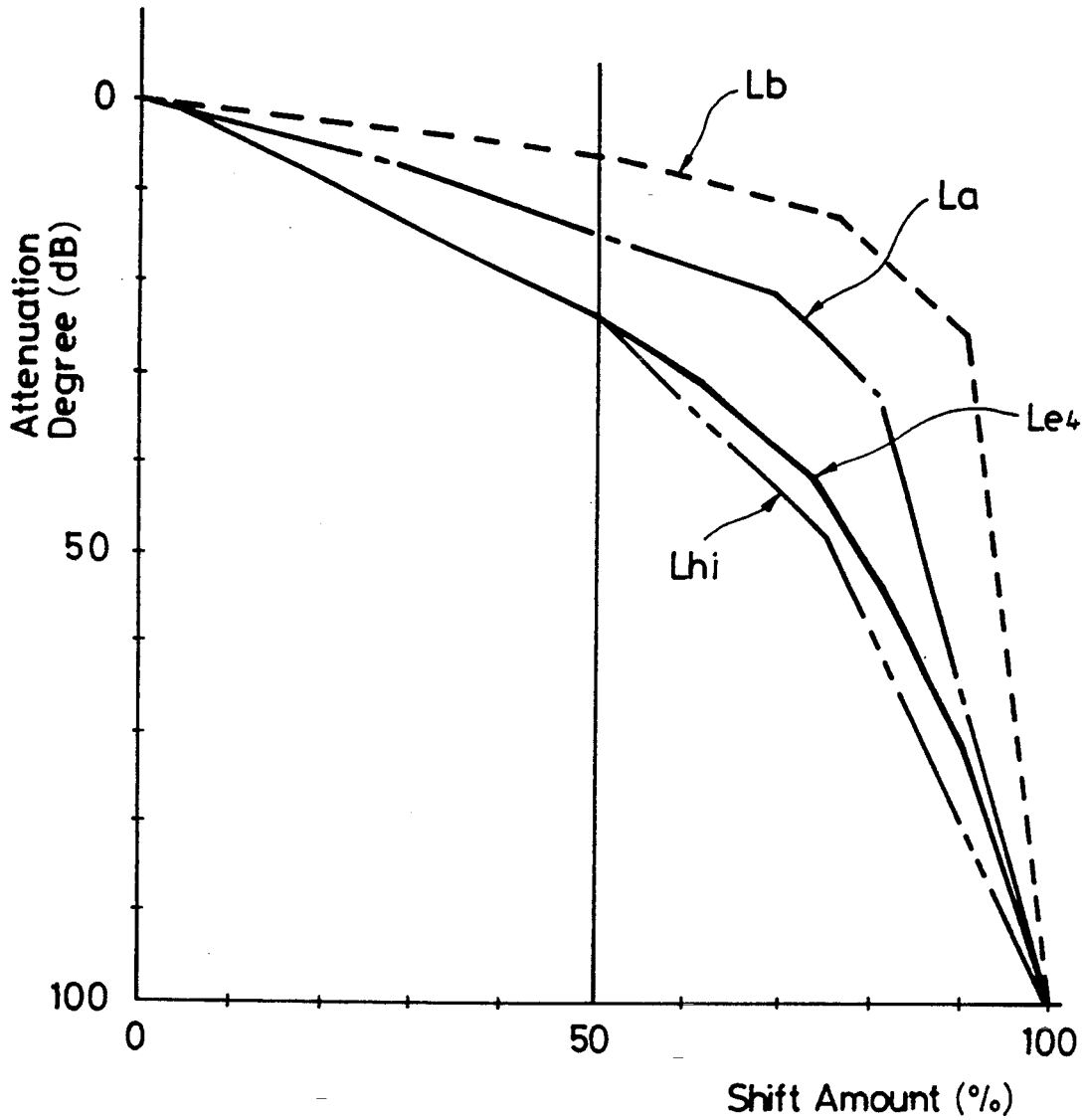
FIG. 7 is a schematic diagram showing resistance characteristics of the slide type variable resistor according to the second embodiment.

According to the thus constituted variable resistor 10T in which the resistance values R7 and R8 of the resistors 7 and 8 are set as described above, the variable resistor can have resistance or attenuation characteristic shown by a steady line Le4 in FIG. 7. In this case, the attenuation degree of the variable resistor at 50% of the shift amount of the slider 14 is more increased to a level almost equal to that of the high grade volume controller with the attenuation characteristic Lhi. Further, the changing ratio of the attenuation degree in a region where the shift amount of the slider 14 exceeds 50% is made gentle to a level almost equal to that Lhi of the high grade volume controller. Thus, the second embodiment can easily provide the variable resistor which is easy to handle and has substantially the same resistance characteristic as that of the high grade volume controller by simple circuit configuration.

While in the above-described respective embodiments the present invention is applied to a slide type variable resistor, the present invention is not limited thereto and may be applied to a rotary type variable resistor with the same effect being achieved.

As set out above, according to this invention, since a main resistor having the linear resistance characteristic, that is, B-curve resistance characteristic is disposed along another resistor having the B-curve resistance characteristic, one ends of the main and another resistors are connected with each other, and the main and another resistors are connected by the slider, it is possible to obtain a variable resistor having resistance characteristic of a high accuracy suitable for the volume control at a low cost.

Having described the preferred embodiments of the invention with reference to the accompanying drawings, it is to be understood that the invention is not limited to those precise embodiments and that various changes and modifications thereof could be effected by one skilled in the art without departing from the spirit or scope of the invention as defined in the appended claims.

What is claimed is:

1. A variable resistor having a non-linear resistance or attenuation characteristic suitable for use as a volume control, comprising:

an input terminal and an output terminal;

a first resistor having a linear resistance or attenuation characteristic, and including a first end, a second end connected to said input terminal, and having a predetermined first resistance value between said first and said second ends;

a second resistor disposed alongside said first resistor and having a linear resistance or attenuation characteristic, said second resistor including a first end, a second end connected to said output terminal, and having a predetermined second resistance value, lower than said first resistance value, between said first and said second ends;

a slider for bridging said first and second resistors at locations intermediate said first and said second ends of said first and second resistors, said first end of each of said first and second resistors being connected, said first and second resistance values being selected whereby said variable resistor has an overall impedance characteristic suitable for volume control.

2. The variable resistor according to claim 1, wherein a ratio of said first and second resistance values is substantially 5:1.

3. The variable resistor according to claim 1, further comprising intermediate taps provided at predetermined locations along said first resistor, which taps are adapted to be connected to said first end of said first and second resistors through resistor means.

4. The variable resistor according to claim 1, wherein each of said first and second resistors is formed of carbonaceous film printed on an insulating substrate.

5. A variable resistor comprising:

a first resistor having a linear resistance or attenuation characteristic, and including a first end and a second and with a predetermined resistance between said first and said second ends;

a second resistor disposed along said first resistor and having a linear resistance or attenuation characteristic, said second resistor including a first end and a second end with a predetermined resistance between said first and said second ends;

a slider for bridging said first and second resistors at locations intermediate said first and said second ends of said first and second resistors, said first end of each of said first and second resistors being connected, and further comprising intermediate taps provided at predetermined locations along said first resistor, which taps are adapted to be connected to said first end of said first and second resistors through resistor means; wherein said intermediate taps are two in number and are respectively located at 50% and 70% of a shift amount of said slider between said first and second ends of each of said first and second resistors.

6. A variable resistor circuit for use as a volume control for an audio signal, comprising:

an output terminal;

an input terminal to which said audio signal is input;

a reference potential terminal;

a first resistor having a first end connected to said reference potential terminal and a second end to said input terminal, said first resistor having a first predetermined resistance between said first and second ends of said first resistor;

a second resistor having a first end connected to said first end of said first resistor and to said reference potential terminal and a second end connected to said output terminal, said second resistor having a second predetermined resistance lower than said first predetermined resistance, between said first and said second ends of said second resistor; and a slide member interconnecting said first and said second resistors at locations between said first and said second ends of said first and said second resistors and arranged to slide along said first and second resistors between said first and said second ends, respectively, said first and second predetermined resistances being selected whereby said variable resistor circuit has an overall attenuation characteristic wherein the degree of attenuation when said slide member is at its 50% shift position is sufficient to accurately control the volume of said audio signal.

7. A variable resistor as set forth in claim 6 wherein said reference potential terminal is a ground terminal.

8. A variable resistor as set forth in claim 7 further including a source of said audio signal and an amplifier circuit for receiving said audio signals from said output terminal, wherein the audio signal is attenuated according to the position of the slide member so that a portion of the second resistor between the output terminal and the slide member does not affect the attenuation of the variable resistor.

9. A variable resistor as set forth in claim 8 wherein a ratio between resistance values of the first and second resistors is 5:1.

10. A variable resistor as set forth in claim 6 wherein said first resistor has at least one intermediate tap connected to an intermediate tap terminal connected through a resistor to a source of reference potential.

11. A variable resistor circuit, comprising:

an output terminal;

an input terminal;

a reference potential terminal;

a first resistor having a first end connected to said reference potential terminal and a second end to said input terminal, said first resistor defining a predetermined resistance between said first and said second ends of said first resistor;

a second resistor having a first end connected to said first end of said first resistor and to said reference potential terminal and a second end connected to said output terminal, said second resistor defining a predetermined resistance between said first and said second ends of said second resistor; and a slide member interconnecting said first and said second resistors at locations between said first and said second ends of said first and said second resistors and arranged to slide along said first and said second resistors between said first and said second ends, respectively; and further including a first and second intermediate terminal, and a first and second intermediate tap on said first resistor at positions corresponding to 50% and 70% of the shift amount of the slide member, said first and said second intermediate taps being respectively connected to said first and said second intermediate terminals.

12. A variable resistor as set forth in claim 11 wherein said first and said second intermediate taps are respectively connected to resistors which in turn are connected to a source of reference potential.

* * * * *